United States Patent [19]

Sullivan et al.

[11] 3,973,846

[45] Aug. 10, 1976

[54] ELECTROSTATIC MASTER MAKING APPARATUS

[75] Inventors: William A. Sullivan, Webster; James R. Cassano, Penfield; David O. Kingsland, Fairport, all of N.Y.

[73] Assignee: Xerox Corporation, Stamford, Conn.

[22] Filed: Sept. 25, 1974

[21] Appl. No.: 508,922

[52] U.S. Cl. ..... 355/16; 355/3 R; 427/22

[51] Int. Cl.[2] ..... G03G 15/00

[58] Field of Search ..... 355/16, 3 R, 17, 11, 355/14, 3 DD, 3 FU; 427/22; 118/637

[56] References Cited

UNITED STATES PATENTS

| | | | |
|---|---|---|---|
| 3,547,534 | 12/1970 | Akiyama et al. | 355/5 |
| 3,600,210 | 8/1971 | Haycock | 117/17.5 |
| 3,615,128 | 10/1971 | Bhagat | 355/3 R |
| 3,795,442 | 3/1974 | Kimura et al. | 355/3 R |
| 3,843,251 | 10/1974 | Washio et al. | 355/16 X |

*Primary Examiner*—R. L. Moses

[57] ABSTRACT

A copying system wherein a document master such as a page of a book, is electrostatically prepared on a photosensitive material in serial form as, for example, fanfolded web. The web bearing the masters is then used with an electrostatic type copier of a type adapted to automatically handle fanfolded material. The ends of the master bearing web may be joined together to form an endless loop to enable the masters to be recopied in sequence the number of times required to produce the number of book copies desired.

5 Claims, 5 Drawing Figures

ELECTROSTATIC MASTER MAKING APPARATUS

This invention relates to a reproduction system, and more particularly to improved reproduction system for producing high quality copies.

Present day copying systems are often faced with a demand for very high quality copies in great numbers as for example when preparing reports. In this context, it is often desirable to add or substract information, or to compose a special copy, or to vary the magnification, or make corrections, etc. so that the final product represents a high quality sometimes unique product. One way of effecting this is to use an intermediate or master from which the final copies are produced.

It is often useful in copying, and particularly where masters are employed to prepare copies in book form. One way of accomplishing this is to couple the system reproduction machine or copier with a sorter, the latter serving to segregate the copies made in successive bins page by page. When copying of the last page is completed, the copies in each bin each then represent a complete book and the sorter can be emptied bin by bin and the contents bound together as by stapling to provide books.

It may, however, be desirable to avoid the use of a sorter, and in this situation another arrangement presents itself. Here, originals or masters are copied once, one page at a time, to provide one book copy, commonly termed a set, and this process is repeated for the second set, and so forth, and so on until the number of copy sets desired is made. In this arrangement, the copies may be collected in the same output tray, rather than in different bins of a sorter, and a relatively simple offsetting device provided to displace each book set slightly from the next for recognition purposes.

Unfortunately, the effectiveness of this latter system may be compromised due to the excessive handling of the originals that is required, since each original must be repeatedly placed on the platen of the copier a number of times equal to the number of set desired. This particularly in the case of a book original having a large number of pages and/or where a great number of copy sets is desired, could be untenable, particularly where the originals must be manually handled. As a result, automatic handling of the originals is generally considered necessary, but automatic document handlers having the speed, reliability and ability to avoid damaging the originals have been difficult to achieve.

It is a principle object of the present invention to provide a new and improved document reproduction system.

It is a further object of the present invention to provide a document reproduction system and method for producing high quality copies.

It is an object of the present invention to provide a reproduction system wherein an intermediate photoconductive material is utilized to support master copies of the documents to be copied.

It is an object of the present invention to provide method and apparatus for producing high quality copies of originals by producing electrostatically master reproductions on a web-like intermediate, wherein each master may, before fixing, be viewed and corrections, alterations, and other quality enchancing changes made, following which the masters are used to produce the copies desired.

It is an object of the present invention to provide a document reproduction system in which an intermediate master capable of being edited is used to produce book copies.

It is an object of the present invention to provide an improved book making method and apparatus.

This invention relates to a method for producing masters on a photosensitive web for later use in producing copies, the steps comprising charging the web in preparation for imaging, exposing the charged web to an original being copied to produce a latent electrostatic image of the original on the web; developing the image to provide a visible image; viewing the visible image and making corrections before fusing the image developed on the web; and fusing the corrected image to provide a permanent master.

The invention further relates to an apparatus for producing masters on a charged photosensitive web for later use as a source for copies, the combination of means forming a first station for exposing the web to an original whereby to form a latent electrostatic image of the original on the web, means forming a second station for developing the web whereby to render the latent image visible, means forming a third station for viewing the developed image on the web whereby the developed images may be corrected before fusing thereof, means forming a fourth station for fusing the developed image on the web whereby to provide a permanent image for use as a master, and means for moving the web from station to station.

Other objects and advantages of the present invention will be apparent from the ensuing description and drawings in which.

The term master as used herein signifies a high quality reproduction of an original which may or may not be retouched, or edited, or of the same or different magnification. A master may also comprise a composite of one or more originals.

Figure 1:
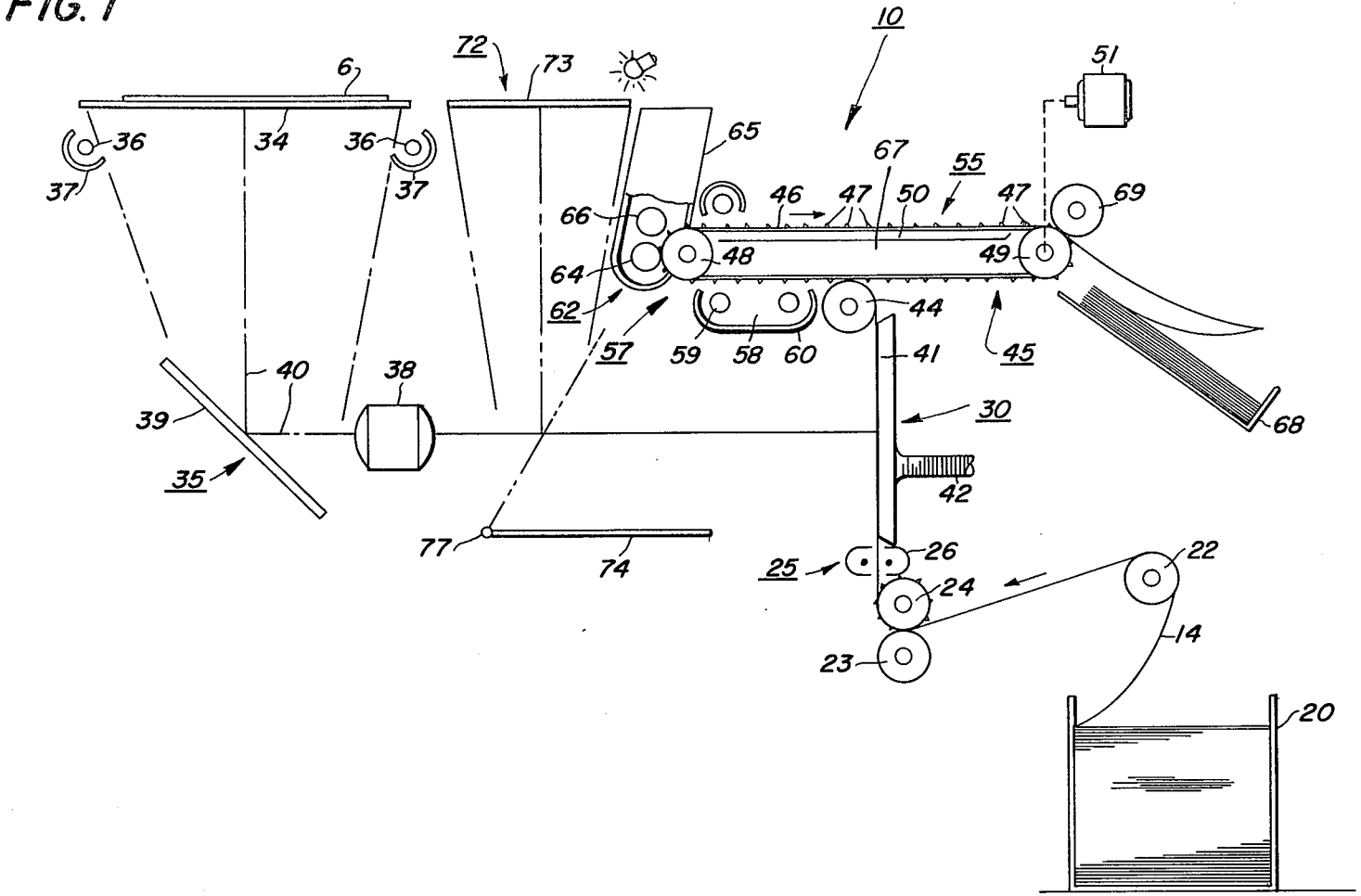
FIG. 1 is a schematic sectional view showing the improved master maker of the present invention.
Figure 4:
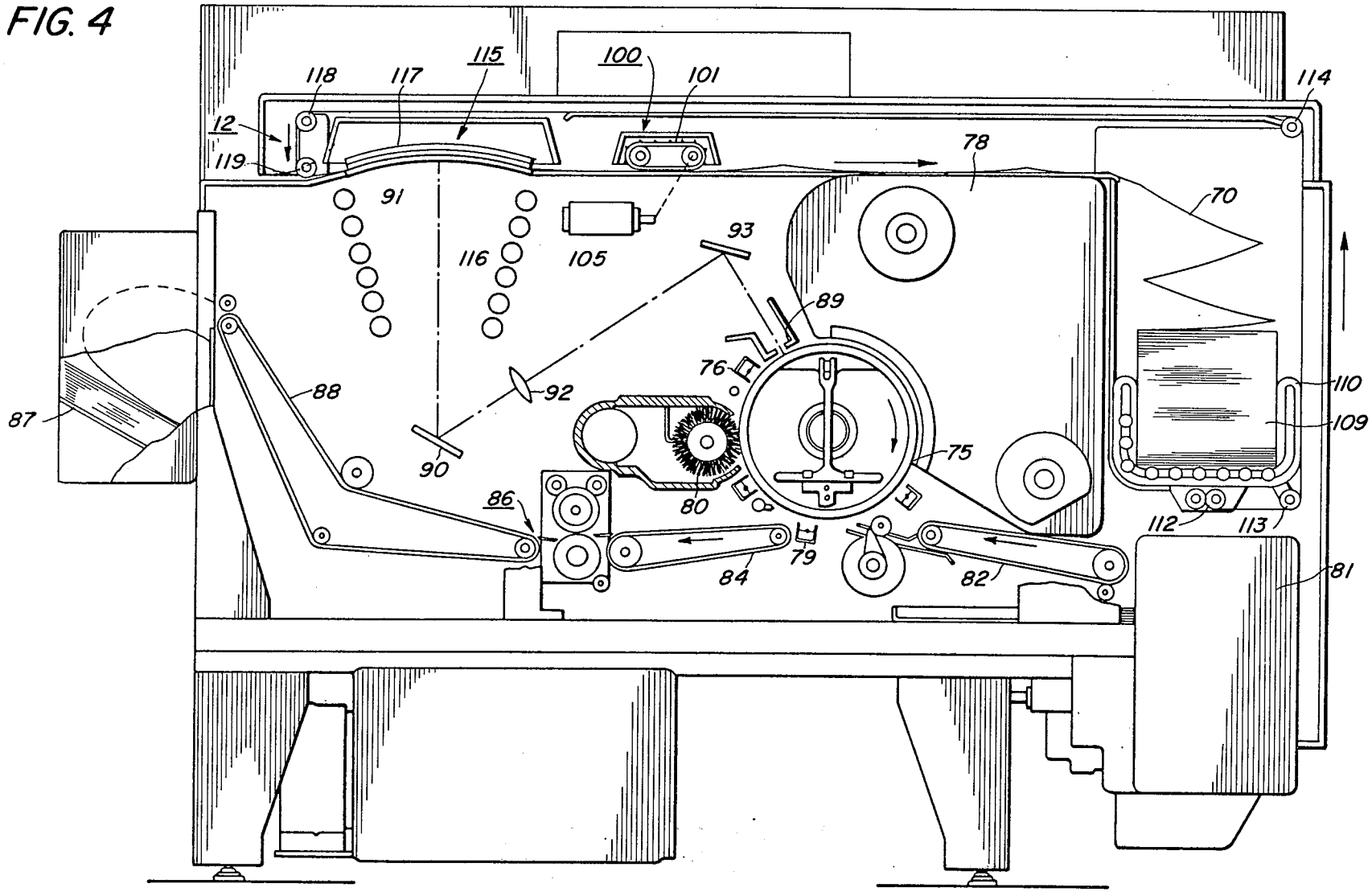
FIG. 4 is a schematic view of an exemplary copier adapted for use in carrying out the present invention.

Referring particularly to FIG. 1 of the drawings, there is shown the master maker of the present invention, designated generally by the numeral 10, and in FIG. 4 a reproduction machine or copier, designated generally by the numeral 12 for utilizing the web 14 of masters prepared by master maker 10. While the master maker 10 and copier 12 are illustrated as being off-line, an on-line arrangement wherein the master copies produced by master maker 10 is fed directly to copier 12 may also be envisioned.

Figure 2:
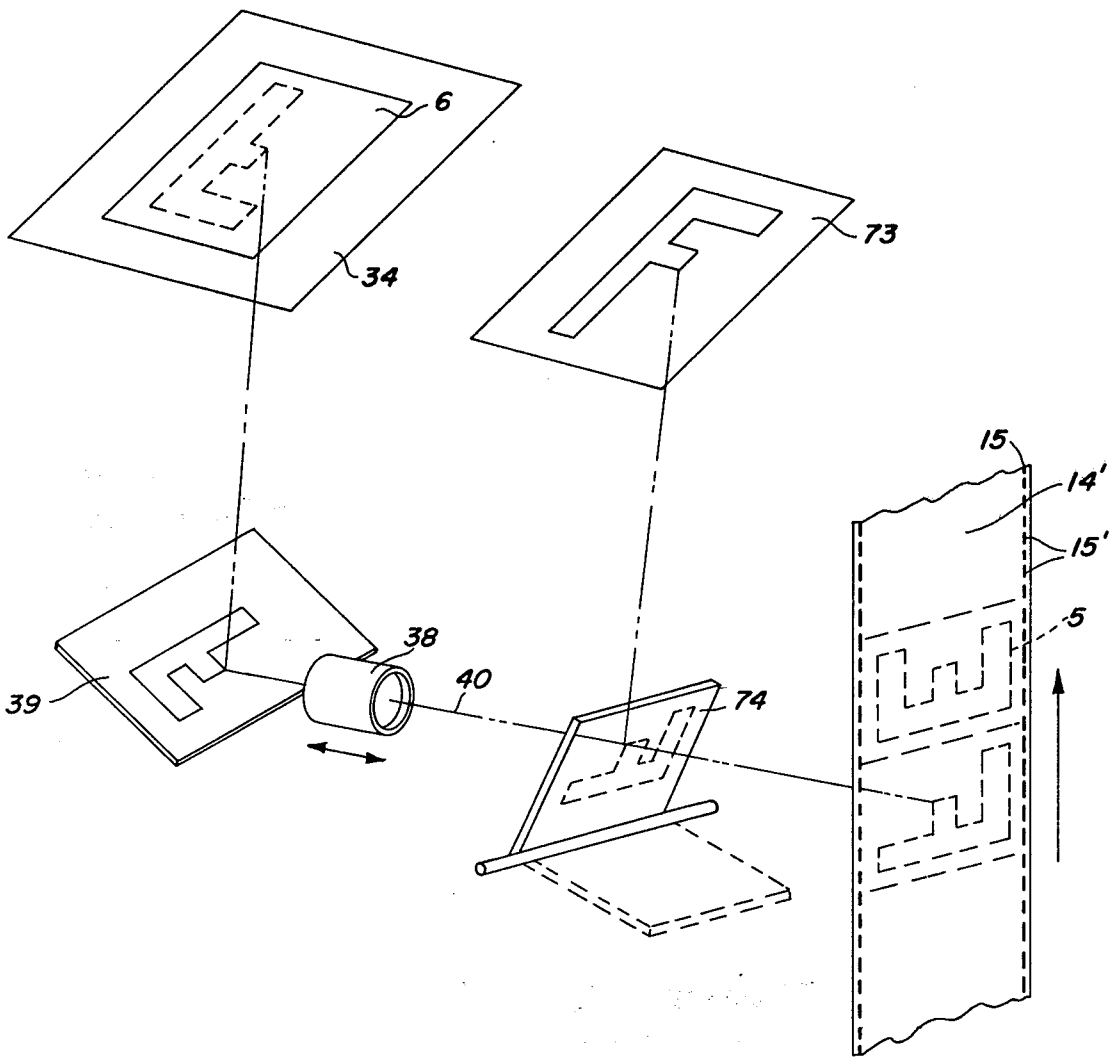
FIG. 2 is an isometric view showing details of the optical system for the master maker shown in FIG. 1.

Referring now to FIGS. 1 and 2 of the drawings, master maker 10 is adapted to prepare a master 5 of each discrete piece of original material 6 being copied, the masters normally being prepared in sequence on web 14. In the instance where the original material 6 comprises one page of a multi-page document, i.e. a book, one master for each page of the book is usually prepared, normally in sequence on web 14 to form a set. In that case, where individual book identity is to be preserved, the length of the master bearing web is sufficient only to accommodate all the pages that comprise the book being copied. The master bearing web 14 may then be used to produce a desired number of copy sets as by means of copier 12. For this purpose, the open ends of web 14 may be joined together to form an endless loop. This permits web 14 to be recycled the number of times required to produce the number of copy sets desired, it being understood that each copy set is produced in the order in which the masters 5 appear on web 14 and without the need of a sorter.

Master bearing web 14 comprises a suitable photosensitive material such as zinc oxide paper. To facilitate handling thereof, web 14 is preferably fanfolded with side margins 15 being perforated at 15' for driving engagement with the web feeding means as will appear.

Referring particularly to FIG. 1, a suitable tray 20 for holding a supply of web 14 is provided. From tray 20, web 14 is routed over guide roll 22 and between pinch roll pair 23, 24 to charging station 25. At charging station 25, a suitable corona charging device, such as corotron 26, applies a predetermined charge to the photoconductive surface of web 14 in preparation for imaging.

Following charging station 25, web 14 is advanced to exposure station 30 whereat the charged web is exposed to the original material 6 or a suitable support surface such as a transparent platen 34 via an optical system such as the configuration 35. As will be understood, transparent platen 34, permits the image rays reflected from the original material 6 to pass therethrough. Suitable illumination means such as lamps 36 are provided below platen 34 and to one side of the optical path to illuminate the original material on platen 34. Reflectors 37 serve to focus the light from lamps 36 toward platen 34.

Optical system 35 includes a suitable lens 38 for focuing the object rays from the original material 6 onto web 14 at exposure station 30. Object mirror 39 functions to turn the object rays from the original material 6 through approximately 90° to lens 38. As will be understood, the optical system 35 may be arranged to provide variable magnification.

To facilitate exposure and obviate distortion, a suitable backing or support platen 41 may be provided at exposure station 30 for web 14. Platen 41 preferably comprises a vacuum type platen, and for this purpose, communicates with a suitable source of below atmospheric pressure via conduit 42. It will be understood that the surface of platen 41 facing web 14 is substantially flat and is provided with suitable vacuum holddown ports (not shown).

Following exposure station 30, web 14 passes into the nip formed by a suitable electrically insulated guide roller 44 and vacuum belt transport 45. Transport 45, which is generally horizontal, comprises a suitable porous, flexible belt element 46, the dimension of which is slightly greater than that of web 14. Belt 46 is provided, along each side thereof with a series of projecting teeth 47 adapted to engage with perforations 15' in web 14.

The internal frame 67 of transport 45 rotatably journals belt support rollers 48, 49 at opposite ends thereof. Frame 67 includes a vacuum plenum 50 extending below the top run of belt 46, plenum 50 cooperating with belt 46 to form a substantially flat editing station 55 as will appear. Roller 49 of transport 45 is drivingly connected to a suitable motor, i.e. step motor 51 for operating transport 45 and moving web 14.

The web 14 leaving exposure station 30 passes between the nip formed by roller 44 and transport belt 46 to fixing station 57 whereat the developed image on web 14 is fused by fuser 58. Fuser 58 includes a suitable source of heat such as lamps 59 and cooperating reflecting housing 60. As will appear, fuser 58 is selectively operable to fuse or not fuse the image on web 14.

Following fixing station 57, web 14 is transported by belt 46 to developing station 62 whereat the latent electrostatic image on web 14 is rendered visible by the application of a suitable developing material which includes ink particles or toner thereto. For this purpose a magentic brush developing roll 64 is disposed in operative juxtaposition with web 14, roll 64 being operatively mounted in the lower or sump portion of a developer housing 65. Housing 65 contains a quantity of developing material for this purpose, a suitable mixing auger 66 being provided to maintain the developing material in operative association with developing roll 64.

A pinch roll 69 is provided at the discharge end of transport 45, roll 69 cooperating with transport 45 to form a discharge nip between which web 14 is discharged into output tray 68. There the finished web is stored in folded flat pack style.

To enable the user to compose or edit the original material 6 to be copied, a compose station 72 is provided. Compose station 72 includes a rear projection screen 73 arranged adjacent platen 34, and prefereably in line with the optical image path 40 of lens system 35. To provide a light image of the original 6 material on screen 73 of compose station 72, a displaceable image mirror 74 is provided mirror 74 being pivotally supported at 77 for swinging movement into and out of the optical image path 40. Image mirror 74, when swing to the dotted line position shown in FIG. 1 (the solid line position in FIG. 2) reflects the image rays from lens 38 onto screen 73 of compose station 72, enabling the user to view the original material on platen 34. When it is desired to reproduce the original material 6 on web 14, image mirror 74 is swung to a position out of the optical axis 40 as shown by solid lines in FIG. 1.

In operation, to prepare a master on web 14, the original material 6 to be copied is placed face down on platen 34. With web threaded through pinch rolls 23, 24, over platen 41 of exposure station 30, and into driving engagement with transport 45, lamps 36 are actuated for a preset interval to expose the original 6. The rays from the illuminated document are reflected by object mirror 39 through lens 38, and onto the segment of web 14 at exposure station 30. It is understood that web 14 has been previously charged by corotron 26, and that vacuum is applied to platen 41 to retain web 14 flat and stationary.

Where web 14 comprises fanfolded material, it will be understood that each fanfold section may be conveniently used to support one master, the fanfolds themselves serving as a convenient point of registration. In this circumstance, transport 45 may be indexed forward and backward as will appear by an amount equal to the length of one fanfold segment of web 14. In this context, the fanfolded web 14, when threaded into the master maker 10, is suitably registered such that an uninterrupted fanfold segment of web 14 is disposed at exposure station 30.

Following exposure, transport 45 is actuated to move the exposed segment of web 14 past fixing station 57, which is inoperative at this point, to developing station 62 whereat the latent electrostatic image is developed. Transport 45 brings the developed segment of web 14 forward to editing station 55, where transport 45 is stopped.

The image produced on web 14, which is developed and hence visible but unfused, may be viewed by the user at editing station 55, and changes, corrections, erasures, etc. made. Following this, transport 45 is reversed to carry the image segment back past developing station 65 to fixing station 57. Here, fuser 58 is actuated to fix or fuse the developed image and render the image permanent.

The aforedescribed process is repeated for each original to be copied, the originals being reproduced in sequence on web 14.

Figure 3:
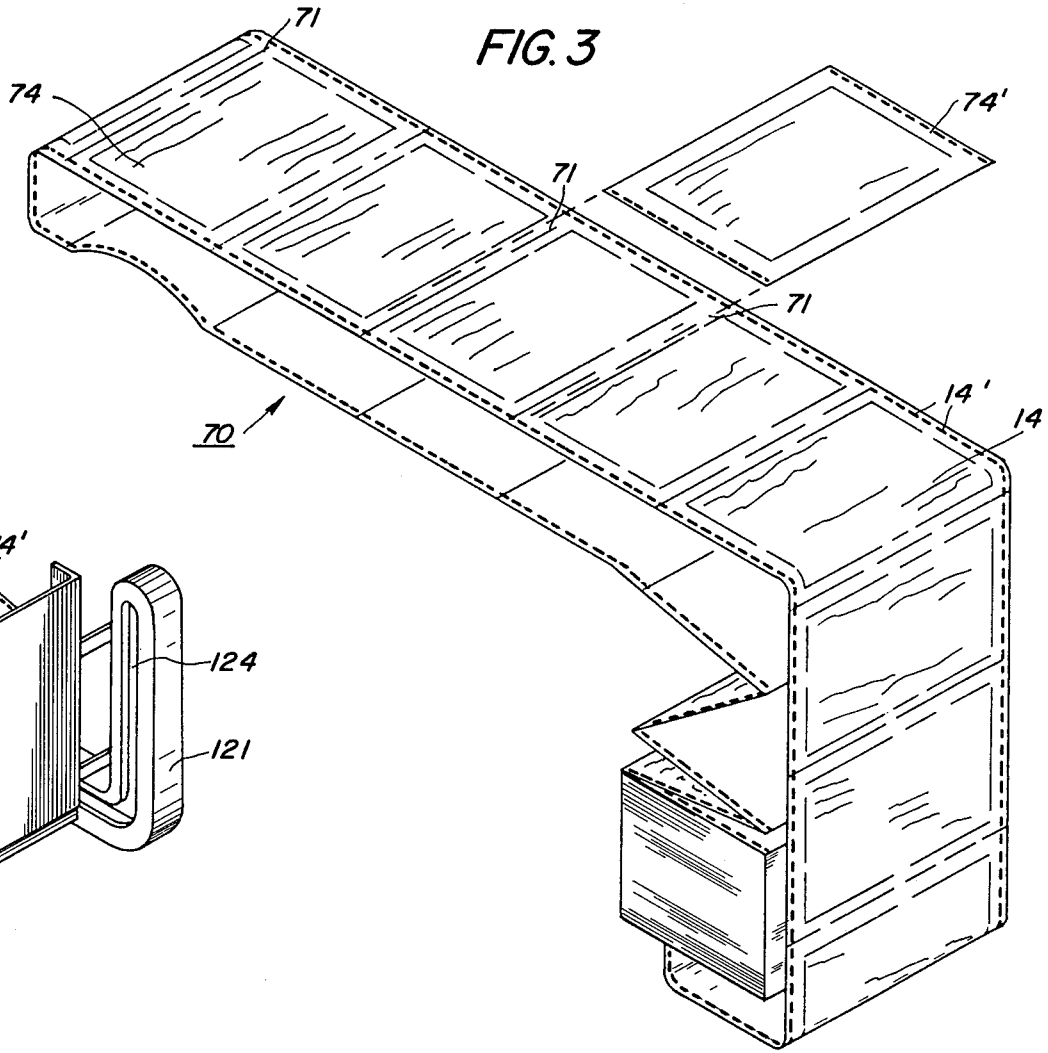
FIG. 3 is an enlarged isometric view showing editing of the master bearing web.

Referring now to FIG. 3, the completed master, bearing web 14, which for example, may comprise the pages of a book, may now be used with copier 12 to produce copies as will appear. Web 14 may, at this time, be conveniently edited to removed, add, and/or substitute masters. For example, if the quality of a master 5 is unacceptable, a new master may be prepared. Substitution of the new master 51 may be effected by cutting the unacceptable master out and inserting the new master in place thereof. The new master may be affixed in position within the web 14 by means of flexible adhesive tape 71. In a similar manner existing masters can be removed or new masters added to the completed web 14.

Referring now to FIG. 4, of the drawings, there is shown an exemplary copier 12 of a type suitable for use with the present invention. Copier 12 has a rotating xerographic drum 75, a corona charging device 76, a xerographic developer 78, a transfer corotron 79 and a drum cleaning brush 80. Copy paper in the form of cut sheets stored in supply tray 81 are fed out one by one by a suitable paper feeder (not shown) onto conveyor 82. Conveyor 82 brings the individual sheets into operative transfer relationship with drum 75 opposite corotron 79 whereat transfer of the image developed on drum 75 to the individual copy sheets takes place. Conveyor 84 carries the image bearing sheets to a roll type fuser 86 where the toner delineated image is permanently fixed. The fused copy is discharged into output tray 87 by conveyor 88.

The xerographic drum 75, following cleaning by brush 80, is charged by the corona charging device 76 prior to exposure to the image being copied at exposure station 89. The image at station 89 originates from scanning by rotating mirror 90 the document resting on platen glass 91, the image reflected by mirror 90 passing through lens 92 and mirror 93 onto the surface of drum 75 at exposure station 89.

Copier 12 is adapted to copy either individual documents or continuous documents as from the master bearing web 14 produced on master maker 10 as described earlier. For web 14, copier 12 includes, adjacent one side of transparent platen 91, a form or web feeder 100 having a pair of endless sprocketed feed tractors 101 cooperable with edge perforations 14 in web 14 to draw the fanfold material across platen 91. Feed tractors 101 are intermittently driven by motor 105 to draw or index the web 14 in increments corresponding to one master 5, copying thereof being effected while drive to feeder sprockets 101 is interrupted and web 14 is stationary.

As seen in FIG. 4, platen 91 of copier 12 is arcuate, the individual document or the portion of fanfolded web 14 then being copied resting thereupon during the copying cycle. Other platen shapes, i.e. flat, may be readily envisioned.

Web 14 is stored in flat place 109 form in supply tray 110 appended to one side of copier 12. As will appear more fully hereinafter, web 14 is fed from the bottom of supply pack 109 via pinch roll pair 112 and guide rolls 113, 114, 118, and 119 into juxtaposition with platen 91. Rolls 112, 113, 114, 118 and 119 are rotatably supported on the frame of copier 12 by suitable means (not shown).

As seen best in FIG. 4 of the drawings, a platen cover 115 is provided atop platen 91. Cover 115 is hingedly attached to the frame portion (not shown) of copier 12 for raising or lowering movement off of or onto platen 91. Cover 115 serves to protect platen 91 against damage when copier 12 is not in use and, during the copying cycle, to protect the user's eyes against extraneous light emitted by exposure lamps 116. The hinged attachment of cover 115 allows platen 91 to be readily accessed as when loading or unloading individual documents or when locating and threading web 14 into place on copier 12.

Platen cover 115 includes an internal cover part 117 spaced slightly above platen 91 when cover 115 is closed, and cooperably therewith to form a passage between which web 14 passes during the copying cycle. In this manner, cover 115 functions to hold the web in operative juxtaposition with platen 91 as the web passes thereover.

Figure 5:
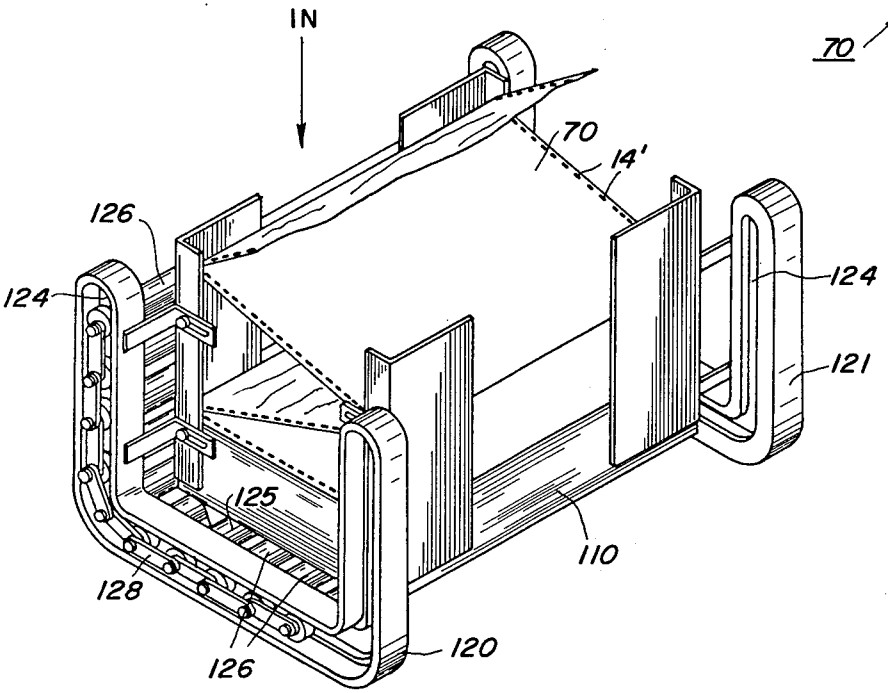
FIG. 5 is an enlarged isometric view showing details of the web supply and dispensing tray.

Referring now to FIG. 5, pack supply tray 110, is comprised of a pair of side members 120, 121 each constructed to form a generally U-shaped track 124 through which a series of rollers 126 making up base 125 of tray 110, extend. Rollers 126 rest within and are supported by side members 120, 121, the dimension of tracks 124 being slightly larger than the diameter of rollers 126. By this construction, rollers 126 are free to turn and base 125 to move back and forth within the confines of tracks 124.

The number of rollers 126 utilized is sufficient to support the pack of fanfolded web 14, and in the exemplary embodiment shown, eight rollers 126 are provided with web 14 being fed between the innermost roller pair. To maintain tray base forming rollers 126 in spaced relationship relative to one another, spacer links 128 are pivotally secured between adjoining rollers at each end thereof.

In operation, as web 14 is withdrawn from the bottom of pack 109, base 125 oscillates back and forth within tracks 124 in accordance with the point of unfolding of web 14 from pack 109. This displacement in the point of unfolding reduces the force required to unfold web 14 and prevents tearing or ripping thereof.

To reproduce masters on web 14, the master bearing web, in the form of a flat pack 109 and with leading and trailing web ends free, is set into supply tray 110. In doing so, the web leading end may be inserted between the innermost rollers of base 125, and from there routed between roll pair 112 and over guide rollers 113, 114, 118, 119 to platen 91. There, the leading end is led across platen 91, cover 115 being raised for this purpose. Since the leading end is normally the first page of the book to be reproduced, the first master 5 on web 14 is in proper location on platen 91 to initiate copying. The trailing end of web 14 is drawn off of the top of pack 109 and threaded onto tractors 101. Following this, the leading and trailing ends of web 14 are abutted and joined together by adhesive tape 71 to form an endless loop. On closing of cover 115, copier 12 is ready for operation, presuming the various operating components thereof, i.e. fuser 86 are in a state of readiness.

With web 14 loaded, the operator selects the number of copy sets desired and activates the copier 12 as by means of a suitable print/start button (not shown). Copier 12 thereafter proceeds to copy each master once, feeder tractor 101 being actuated following each copy to index web 14 to bring the next master into position on platen 91. As copies of web 14 are made, fresh web material is unfolded from the bottom of pack 109 and routed over guide rolls 112, 113, 114, 118 and 119 to platen 91. At the same time, the used web is restacked onto pack 109. The above proceeds until the last master on web 14 has been copied, at which point copier 12 is stopped or the above procedure repeated to form another set of copies in accordance with the program under which copier 12 is operated.

While the invention has been described with reference to the structure disclosed, it is not confined to the details set forth, but is intended to cover such modifications or changes as may come within the scope of the following claims.

What is claimed is:

1. In the method of producing masters on a photosensitive web for later use in producing copies, the steps which consist of;

a. charging the web in preparation for imaging;

b. exposing the charged web to an original to provide a latent electrostatic image of the original on the web;

c. electrostatically developing the image to provide a visible image;

d. before fusing, viewing the electrostatically developed visible image and while the image is unfused making corrections preparatory to permanently fixing the developed image;

e. fusing the corrected image to provide a permanent master; and advancing the web in increments for each process step.

2. In an apparatus for producing masters on a charged photosensitive web for later use as a source for copies, the combination of:

a. means forming a first station for exposing said web to an original whereby to form a latent electrostatic image of the original thereon;

b. means forming a second station for developing said web whereby to render the latent electrostatic image thereon visible;

c. means forming a third station for viewing the developed images on said web whereby corrections of the developed images may be made before fusing of the image;

d. means forming a fourth station for fusing images developed on said web whereby to provide permanent images for use as masters; and e. means for moving said web from station to station; said moving means including a visual transport segment forming said third station whereat the portion of said web bearing developed images may be viewed for corrective purposes.

3. In an apparatus for producing masters on a charged photosensitive web for later use as a source for copies, the combination of:

a. means forming a first station for exposing said web to an original whereby to form a latent electrostatic image of the original thereon;

b. means forming a second station for developing said web whereby to render the latent electrostatic image thereon visible;

c. means forming a third station for viewing the developed images on said web whereby corrections of the developed images may be made before fusing of the image;

d. means forming a fourth station for fusing images developed on said web whereby to provide permanent images for use as masters; and e. means for moving said web from station to station, said moving means including a visual transport segment forming said third station whereat the portion of said web bearing developed images may be viewed for corrective purposes, said moving means being reversible to enable said web to be moved back and forth between said stations.

4. The apparatus according to claim 3, in which said fourth station is disposed between said first and second stations.

5. In an apparatus for producing masters on a charged photosensitive web for later use as a source for copies; the combination of:

a. means forming a first station for exposing said web to an original whereby to form a latent electrostatic image of the original thereon;

b. means forming a second station for developing said web whereby to render the latent electrostatic image thereon visible;

c. means forming a third station for viewing the developed images on said web whereby corrections of the developed images may be made before fusing of the image;

d. means forming a fourth station for fusing images developed on said web whereby to provide permanent images for use as masters; and e. means for moving said web from station to station; said web being comprised of a zinc oxide material.

* * * * *